US005975965A

United States Patent [19]

Jordan

[11] Patent Number: 5,975,965

[45] Date of Patent: Nov. 2, 1999

[54] COAXIAL CONNECTOR BODY

[75] Inventor: Peter Jordan, Basingstoke, United Kingdom

[73] Assignee: ITT Manufacturing Enterprises, Inc., Wilmington, Del.

[21] Appl. No.: 08/923,711

[22] Filed: Sep. 4, 1997

[30] Foreign Application Priority Data

Sep. 19, 1996 [GB] United Kingdom ..... 9619552

[51] Int. Cl.[6] ..... H01R 4/10

[52] U.S. Cl. ..... 439/877; 439/882

[58] Field of Search ..... 174/84 R, 84 C, 174/79, 136, 91, 92; 439/879, 877, 880, 878, 881, 882

[56] References Cited

U.S. PATENT DOCUMENTS

| | | | |
|---|---|---|---|
| 368,987 | 8/1887 | Wheeler | 439/859 |
| 2,789,278 | 4/1957 | Soreng | 439/879 |
| 3,643,008 | 2/1972 | Brazee | 439/857 |
| 3,923,367 | 12/1975 | Carter . | |
| 4,070,751 | 1/1978 | Hogendobler et al. . | |
| 4,415,223 | 11/1983 | Asick | 439/879 |
| 4,453,034 | 6/1984 | Annas et al. . | |
| 5,675,891 | 10/1997 | Childs et al. | 29/879 |

FOREIGN PATENT DOCUMENTS

| | | |
|---|---|---|
| 1020714 | 11/1964 | United Kingdom . |
| 1048203 | 5/1965 | United Kingdom . |
| 1211486 | 11/1970 | United Kingdom . |
| 2 040 105 | 7/1979 | United Kingdom . |

*Primary Examiner*—Lincoln Donovan
*Attorney, Agent, or Firm*—Thomas L. Peterson

[57] ABSTRACT

An electrical connector element, especially a coaxial connector body (1), includes a forward connector part (2) and a rearward crimp barrel part (3), formed of a single piece of thin sheet metal, wherein the crimp barrel part is constructed to avoid resilient collapse during crimping. The sheet metal has been rolled into a cylinder with adjacent edges (7, 8), with each edge provided with a circumferentially-projecting tab (11, 12) that overlies the other edge. The two tabs prevent one edge from riding over the other to thereby prevent resilient collapse of the cylinder during crimping, but instead hold the edges adjacent to cause plastic deformation of the crimp barrel part during crimping.

7 Claims, 3 Drawing Sheets

COAXIAL CONNECTOR BODY

BACKGROUND OF THE INVENTION

This invention relates to an electrical connector element in the form of a shell of generally cylindrical shape, and especially to a coaxial connector body with a crimp barrel part and to the manufacture of such body.

A coaxial connector body, or outer coaxial contact of a coaxial connector, is typically formed of sheet metal. The body includes a rear crimp barrel part for crimp connection to a coaxial cable outer conductor, and also includes a forward connector part for mating with another connector. An insulator lies within the connector body and an inner coaxial contact lies within the insulator and connects to the inner conductor of the coaxial cable.

In general, the crimp barrel of the coaxial connector body, is attached to a coaxial cable outer conductor, by use of a ferrule. The coaxial cable outer conductor, which is often in the form of a braid, is placed around the crimp barrel, and the ferrule is placed around the cable outer conductor. A tool compresses the ferrule to crimp the cable outer conductor between the ferrule and the crimp barrel part of the body. The crimp barrel part should undergo plastic deformation during crimping, so the coaxial cable conductor is securely fixed between the ferrule and crimp barrel. To prevent resilient deformation or resilient collapse of the crimp barrel, its adjacent edges should not ride one over the other.

One way to avoid the edges of the crimp barrel from riding over one another, is to use thick sheet metal. However, where the front part of the body forms a socket with resilient fingers, such fingers should be of thin sheet metal, which would be incompatible with thick sheet metal for the crimp barrel. Previously, such connector bodies have been formed by separate construction of the socket part and crimp barrel part, which had to be fixed together, at increased cost. It would be desirable if the crimp barrel part and connector part of a coaxial connector body could be constructed of a single thin piece of sheet metal, with the crimp barrel part constructed to avoid resilient collapse by one edge riding over the other. Such construction could be useful for any other electrical connector element wherein a piece of sheet metal is rolled into a largely cylindrical shape.

SUMMARY OF THE INVENTION

In accordance with one embodiment of the present invention, an electrical connector element, especially a coaxial connector body, is provided wherein thin sheet metal can be used for a one piece body, with the crimp barrel part constructed to assure plastic deformation during crimping. The piece of sheet metal had been formed largely into a cylinder with adjacent longitudinally-extending edges that preferably abut each other. To prevent the edges from riding one over the other during crimping, each edge is provided with an overlap means. The overlap means can comprise a first tab extending from a first edge to overlap the second edge, and a second tab extending from the second edge to overlap the first edge. The tabs both lie radially outward, or both radially inward, of the edge that they overlap. When the largely cylindrical crimp body part is compressed during crimping to a coaxial cable outer conductor, the tabs prevent one edge from climbing or riding over or under the other.

The tabs preferably overlap adjacent edges by a distance at least equal to the thickness of the sheet metal, and more preferably at least twice the thickness of the sheet metal. This avoids one edge riding over the other if there is a slight gap between the edges. The crimp barrel part can include two knurled annular sections, preferably of greater diameter than other areas of the crimp barrel part. A first tab extends from the first of the knurled annular sections, while a second tab extends from the second knurled annular section. The end of each knurled annular section extends inwardly from a simple circumferential direction, to enable a tab to fit over it with minimal outward protrusion of the tab.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
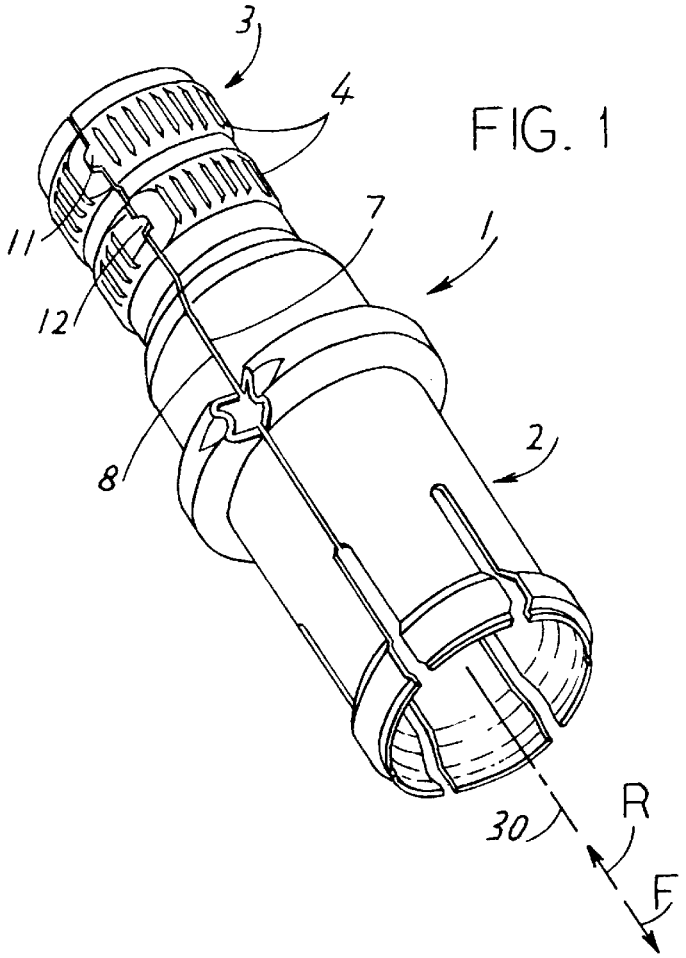
FIG. 1 is a isometric view of a coaxial connector body of the invention.

FIG. 1 shows a coaxial connector body 1 which can be formed from a piece of sheet metal or plate, by stamping the piece from a larger sheet and deforming selected areas, and then rolling the sheet around an axis 30 to form generally cylindrical sections. The body has a forward coaxial connector part 2 adapted for releasable engagement with another coaxial connector body. The coaxial connector part 2 shown in FIG. 1 is a socket that includes a plurality of spring fingers. The connector part can instead be formed as a male part such as a pin.

Figure 7:
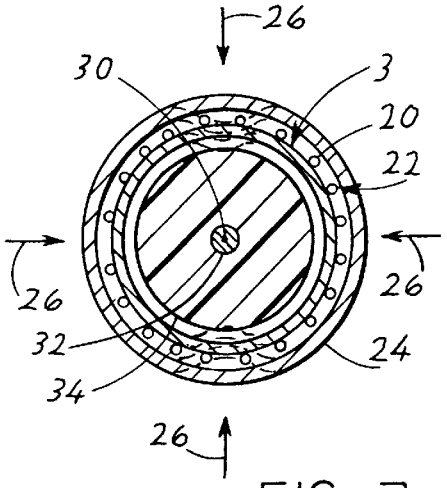
FIG. 7 is a sectional view of the crimp barrel, showing the rest of the connector, a cable outer conductor, and a crimp ferrule, with a pair of crimps shown in phantom lines.

The connector body 1 also includes a rearward crimp barrel part 3 with adjacent longitudinal edge areas or edges 7, 8 that substantially abut one another. The crimp barrel is constructed so the outer conductor of a coaxial cable can be wrapped about it and crimped to it by the use of a ferrule. FIG. 7 shows an entire assembly which includes the cable outer conductor 20, (usually in the form of a wire braiding) of a cable 22, which surrounds the crimp barrel part 3, and a ferrule 24 surrounding the cable outer conductor. Forces applied such as at the four locations 26, deform the ferrule radially inwardly toward the axis 30, and press the cable outer conductor 20 against the crimp barrel 3. It is desirable that the crimp barrel be plastically deformed radially inwardly at the crimp location 26, rather than having its edges override each other and cause the largely cylindrical crimp barrel part to only resiliently deform by deforming into a smaller diameter cylinder with overlapping edges. FIG. 7 also shows a coaxial connector inner contact 32 and an insulator 34.

Figure 4:
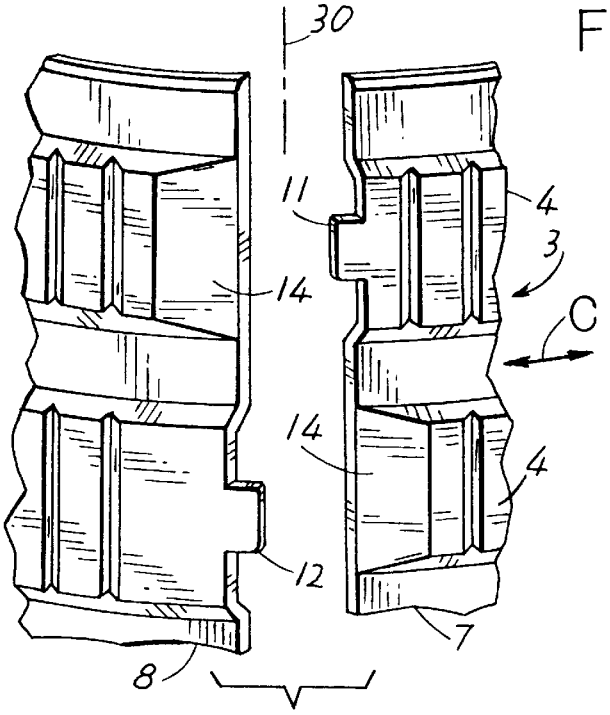
FIG. 4 is an enlarged isometric view of a portion of the crimp barrel part of FIG. 2, with the edges separated.

In order to provide the structural strength in the crimp barrel part 3 (FIG. 1) that is needed to prevent only resilient deformation during crimping, overlap means are provided to prevent one of the edges 7, 8 from riding radially over or under the other. In the embodiment shown in FIG. 1, the overlap means includes first and second tabs 11, 12 (additional tabs can be used). As shown in FIG. 4, each tab 11, 12 extends from a corresponding one of the longitudinal edges 7, 8 from one of the two narrow knurled annular sections 4 of the crimp barrel 3. Each tab overlaps an opposite edge by lying radially outward of the opposite edge. The first tab 11 prevents the first edge 7 from slipping under, or radially inward, of the second edge 8, while the second tab 12 prevents the second edge 8 from slipping under, or radially inward, of the first edge 7. The tabs 11, 12 need to be of sufficient length in a circumferential direction (relative to axis 30) that during crimping, resilient compression of the crimp barrel part will not occur, but instead the crimp barrel will be plastically deformed at the crimp locations.

In a preferred embodiment of the invention that applicant has designed, the connector body is formed from phosphor bronze sheet of 0.3 mm thickness. In this case an overlap of about 0.25 mm or 0.3 mm is about the minimum amount required to provide the needed structural strength. That is, the tabs should extend far enough that there is no danger of the gap between the adjacent edges being wide enough that one edge will ride radially outward of an opposed tab. Applicant provides an overlap along a circumferential (direction C) distance of preferably more than the sheet metal thickness, and preferably more than twice as great, as along a distance of about 0.6 mm.

Figure 3:
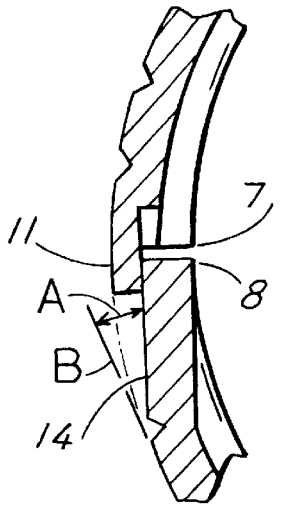
FIG. 3 is a sectional view of a portion of the crimp barrel part of the body of FIG. 2.
Figure 2:
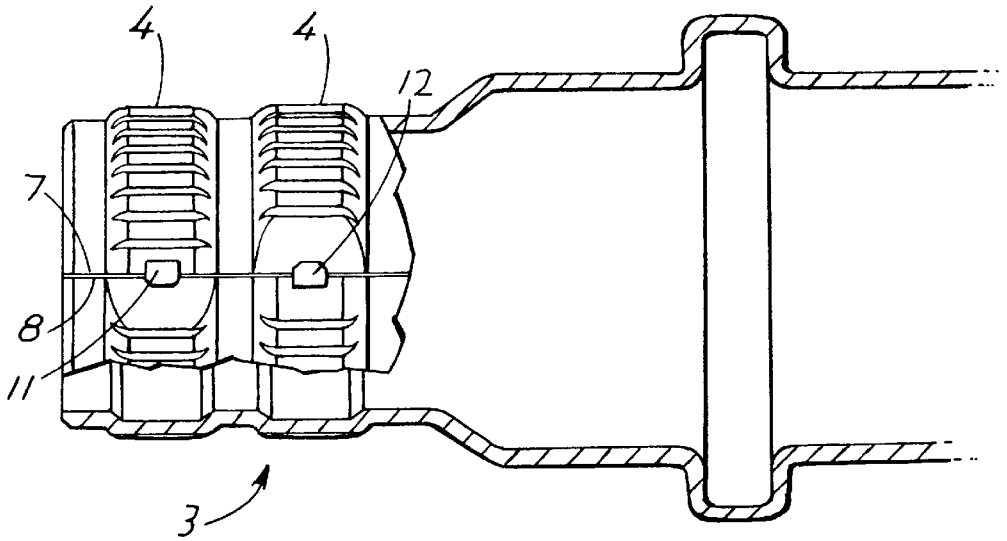
FIG. 2 is a plan view of the crimp barrel part of the coaxial connector body of FIG. 1, shown in section.

As can be seen from FIGS. 2 and 4, the tabs 11, 12 are shown located on the two narrow annular sections 4 of the crimp barrel part 3. The sections are narrowed except at the edge which is to be overlapped by a tab. At such edges, there is no knurling, but instead a flat sloped part 14 is provided that is sloped by an angle A (FIG. 3) from a line B that extends in a circumferential and which is a continuation of the rest of the knurled section. This results in the tab 11 not projecting radially outward so large concentrated forces are not applied to the areas where the tabs lie. Applicant prefers to thin the sheet metal at the tabs as shown in FIG. 3 to minimize radially outward projection.

The knurled sections 4 of the crimp barrel part are of greater diameter than the remainder of the crimp barrel part 3 to provide a satisfactory engagement with the crimped cable. However, the crimped barrel part 3 is, itself, of smaller diameter than the front connector part 2.

Figure 5:
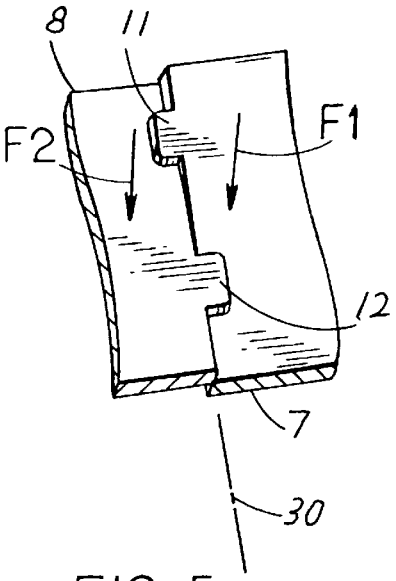
FIG. 5 is a simplified isometric view of the crimp barrel part of FIG. 4, with the edges moved together.

FIG. 5 shows that if a radially inward force F1 is applied to the area of the edge 7, this will cause the tab 11 to press against the edge area 8, preventing the edge area 7 from riding radially inward (with respect to the axis 30) of the edge area 8. Similarly, a radially inward force F2 applied to the edge area 8 will cause the tab 12 to press against the edge area 7 and prevent the edge area 8 from riding radially inward of the edge area 7.

Figure 6:
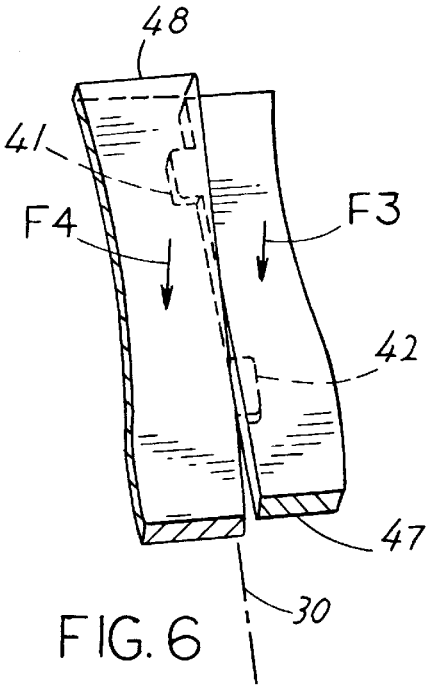
FIG. 6 is a simplified isometric view of a portion of a crimp barrel part similar to that of FIG. 5, but with the tabs lying radially inside the edges that they overlap.
Figure 8:
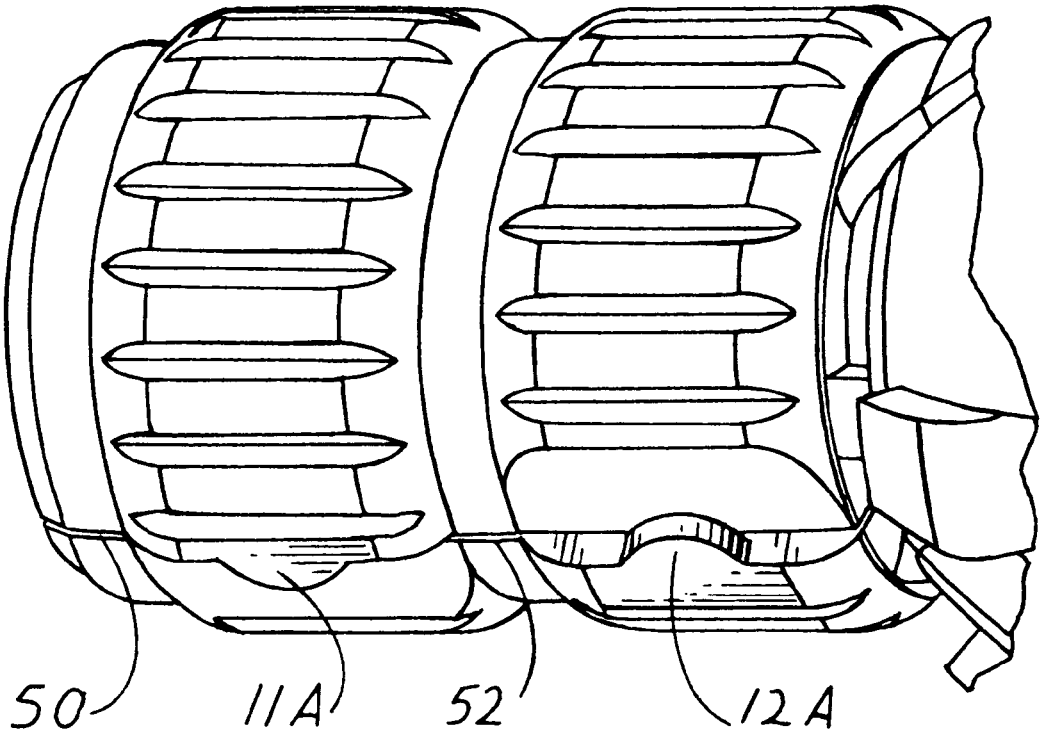
FIG. 8 is an isometric view of coaxial connector body of an another embodiment of the invention.

FIG. 6 shows an alternative wherein tabs 41, 42 are provided that project respectively from edge areas 47, 48, with each tab extending radially inward of the opposed edge. If a radially inward force F3 is applied to the edge area 47, this will be resisted by the tab 42, while if a radially inward force F4 is applied to the edge area 48, this will be resisted by the tab 41. Although either of the arrangements of FIGS. 5 and 6 can be used, applicant prefers the arrangement of FIG. 5, wherein each tab lies radially outward of an opposed edge portion, as this enables the tabs to be readily seen when the connector body is constructed. Of course, FIGS. 5 and 6 are simplified examples, in that they do not show the knurled sections, and because they show the adjacent edges skewed. Skewing is avoided, as shown in FIG. 8, by having the interlocking tabs 11A, 12A seating in sub-flush areas. This keeps the adjacent edges aligned, as at 50 and 52.

Applicant prefers to form the sheet metal of phosphor bronze whose properties are particularly suitable for a connector with a crimp barrel, although other sheet metal materials, especially copper based materials, can be used. The manufacture of the coaxial connector body is accomplished by stamping a piece of sheet metal out of a larger sheet, deforming selected parts into the crimp barrels, the fingers or other connector mating parts at the front end, and then rolling or otherwise deforming the sheet metal piece into largely cylindrical areas centered on the axis 30, with the longitudinally-spaced tabs 11, 12 overlapping opposite edges or edge portions as illustrated. Although the use of projecting tabs that overlap is especially useful for coaxial connector bodies, it can be used for any other electrical connector element formed of sheet metal that has been rolled into a largely cylindrical shape, to prevent one edge from overriding the other.

Thus, the invention provides an electrical connector element, and especially a coaxial connector body, which can be formed from the single piece of sheet metal and provide an effective rear crimp barrel part as well as a defective front connector part. The piece of sheet metal is rolled to form a largely cylindrical body, that is, one with largely cylindrical portions spaced along the axis, and is formed with at least one pair of tabs that project primarily circumferentially from opposite edges or edge portions of the body, especially at the crimp barrel part. Each tab overlies an opposite edge, as where both tabs lie radially outward of opposite edges. The tabs prevent each edge from riding radially outward or inward of the opposite edge. This is especially useful in crimping, where large radially inward forces are applied to the crimp barrel part. Instead of providing at least one tab at each edge, it is possible to provide two tabs at one edge, with one tab lying radially outside the opposed edge and the other tab lying radially inside the opposed edge.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical connector element, comprising:

a piece of sheet metal which has first and second opposite edges and which has been rolled into a largely cylindrical shape that is centered on an axis, with said edges lying adjacent and parallel to each other;

said first edge has a first tab that projects primarily circumferentially beyond adjacent locations of said first edge and that overlaps a second edge part of said second edge;

said second edge has a second tab that is axially spaced from said first tab and the projects primarily circumferentially beyond adjacent locations of said second edge and that overlaps a first part of said first edge;

said second edge part is angled radially inwardly from a direction that is circumferential to said axis, to minimize bending of said first tab away from a circumferential direction.

2. A combination of an electrical connector element, and a cable that has an outside, comprising:

a piece of sheet metal which has first and second opposite edges and which has been rolled into a largely cylindrical sleeve that is centered on an axis, with said edges lying adjacent and generally parallel to each other;

said first edge has a first tab that projects primarily circumferentially beyond adjacent locations of said first edge and that overlaps said second edge;

said second edge has a second tab that is axially space from said first tab and that projects primarily circumferentially beyond adjacent locations of said second edge and that overlaps said first edge;

said sleeve being crimped around said cable, with a plurality of sleeve locations that are circumferentially spaced about said axis being deformed toward said axis while said first and second edges abut one another.

3. A coaxial connector body, comprising:

a piece of sheet metal that has been rolled about an axis to form adjacent edges, said rolled piece of sheet metal forming said coaxial connector body with a forward coaxial connector part for releasable engagement with another connector device, and with a rearward crimp barrel part for a crimp connection to a coaxial cable outer conductor;

said crimp barrel part has first and second adjacent edges extending primarily parallel to said axis, and has a first tab extending primarily circumferentially from a first of said edges and a second tab that is axially spaced from said first tab and that extends primarily circumferentially from a second of said tabs, with each tab overlapping an opposite edge;

said crimp barrel part comprises two axially spaced knurled annular sections, and each of said tabs lies at a different one of said knurled sections.

4. The coaxial connector body described in claim 3 wherein:

each of said edges has an inclined location lying opposite one of said tabs, with each inclined location being inclined to extend radially inward from a circumferential direction to receive a tab that extends substantially circumferentially, to avoid large radial protrusion of the tab.

5. The coaxial connector described in claim 3 including:

an insulator lying within said crimp barrel part, a cable outer conductor lying around said crimp barrel part, and a ferrule lying around said cable outer conductor, with each tab lying radially outside an opposite one of said edges and with said edges abutting each other, and with corresponding locations on said ferrule and said crimp barrel part being crimped into said cable outer conductor.

6. The coaxial connector described in claim 3 wherein:

said piece of sheet metal is thinner at each of said tabs than at each of the opposite edge locations that lie opposite the tab.

7. The element described in claim 4 wherein:

said first edge is stamped on its radially inward surface to be of smaller thickness than the average thickness of said piece of sheet metal.

* * * * *